United States Patent [19]

Rossetti

[11] Patent Number: 4,628,247

[45] Date of Patent: Dec. 9, 1986

[54] VOLTAGE REGULATOR

[75] Inventor: Nazzareno Rossetti, Scottsdale, Ariz.

[73] Assignee: SGS Semiconductor Corporation, Phoenix, Ariz.

[21] Appl. No.: 762,273

[22] Filed: Aug. 5, 1985

[51] Int. Cl.[4] ..... G05F 3/20

[52] U.S. Cl. ..... 323/314; 323/907

[58] Field of Search ..... 323/313, 314, 315, 316, 323/907; 307/296 R, 297, 310

[56] References Cited

U.S. PATENT DOCUMENTS 4,100,477 7/1978 Tam ..... 323/314
4,422,033 12/1983 Minner et al. ..... 323/314
4,490,670 12/1984 Wong ..... 323/313

*Primary Examiner*—Peter S. Wong
*Attorney, Agent, or Firm*—M. David Shapiro

[57] ABSTRACT

The invention comprises an improved on-chip voltage regulator which provides output voltages significantly lower than the band gap voltage of silicon with supply voltages as low as 1.0 volt, with the output voltage fully temperature compensated.

6 Claims, 3 Drawing Figures

VOLTAGE REGULATOR

FIELD OF THE INVENTION

The invention relates to an integrated circuit implementation of an improved temperature compensated voltage regulator wherein the regulated voltage may be significantly less than the energy band-gap voltage of silicon and is operable with supply voltages as low as 1.0 volt.

BACKGROUND OF THE INVENTION

Prior art voltage reference generators are exemplified by the circuit of FIG. 1 which was presented by Robert J. Widlar in an article entitled "New Developments in IC Voltage Regulators", IEEE Journal of Solid State Circuits, Volume SC-6, No. 1, pp. 2–7, February 1971. The value of R1 is 600 ohms, R2 is 6000 ohms and R3 is 600 ohms. $V_{REF}$, the regulated output, is $V_{BE}+(R2/R3)\ V_{BE}$. Widlar stated, > ". . . it uses the negative temperature coefficient of emitter-base voltage in conjunction with the positive temperature coefficient of emitter-base voltage differential of two transistors operating at different current densities to make a zero temperature coefficient reference. Practical references can be made at voltages as low as the extrapolated energy band-gap voltage level of the semiconductor material, which is 1.205 V for silicon. A simplified version of this reference is shown in Fig. [1, of this disclosure]. In this circuit, Q1 is operated at a relatively high current density. The current density of Q2 is about 10 times lower and the emitter-base voltage differential $V_{BE}$ between the two devices appears across R3. If the transistors have high current gains, the voltage across R2 will be proportional to $V_{BE}$. Q3 is a gain stage that will regulate the output at a voltage equal to its emitter-base voltage plus the drop across R2."

The voltage across R2 was given as (R2/R3) $V_{BE}$. Widlar, supra, p.3. This circuit develops a minimum output voltage which is close to the energy band gap voltage of silicon, 1.205 volts, and was stated to be temperature invariant at that voltage output level.

An article by A. Paul Brokaw, "A Simple Three-Terminal IC Bandgap Reference", IEEE Journal of Solid-State Circuits, Vol. SC-9. No. 6, December 1974, pp. 388–393 also teaches a circuit which is limited, at its lower outout level to the band-gap voltage of silicon, although Brokaw teaches a circuit which will produce regulated voltages which exceed the band-gap voltage. This referenced prior art depends upon on the equation:

$$V_R=(V_{BE}+K1\Delta V_{BE})K2 \qquad (a)$$

(If K1 and K2 in equation (a) are chosen to be equal to R2/R3 and 1.0, respectively:

$$V_R=(V_{BE}+R2/R3\Delta V_{BE})(b) \qquad (b)$$

is the result.)

Where K1 is a constant chosen so that:

$$dV_{BE}/dT+K1(d\Delta V_{BE}/dT)=0 \qquad (c)$$

and K2 is chosen to give the desired output voltage. It must be greater than 1.0 by definition since it is determined by a resistor divider (Brokaw) or is chosen to be 1.0 to insure proper circuit operation (Widlar), supra.

The unregulated source voltage for such circuits as taught by Widlar and Brokaw must have a minimum level of about 2.06 volts. In U.S. Pat. No. 4,100,477, Richard K. Tam teaches the regulator of FIG. 2 which also has the limitations expressed above. Among other things, Tam teaches the addition of resistor 18 to the basic Widlar circuit of FIG. 1. Other voltage regulator prior art which is known but is not deemed to be as relevant as the Widlar, Brokaw and Tam references is to be found in U.S. Pat. Nos. 2,617,859 to Dobkin et al.; 3,659,121 to Fredericksen; 3,781,648 to Owens; 3,794,861 to Bernacchi; 3,886,435 to Steckler; 3,970,876 to Allen et al.; 3,893,018 to Marley; 4,091,321 to Hanna; 4,339,707 to Gorecki; 4,362,984 to Holland; and 4,447,784 to Dobkin.

SUMMARY OF THE INVENTION

The above and other problems with prior art voltage regulators are resolved in accordance with the instant invention which provides for a regulated output voltage as low as 300 mv which is fully temperature compensated and an unregulated input voltage as low as about 1.0 volt.

It is therefore an object of the invention to provide an integrated circuit voltage regulator which can provide a regulated output voltage as low as 300 millivolts. It is another object of the invention to provide an integrated circuit voltage regulator which can provide an output voltage as low as 300 millivolts with an input voltage as low as 1.0 volts.

It is still another object of the invention to provide an integrated circuit voltage regulator which can provide an output voltage as low as 300 millivolts with an input voltage as low as 1.0 volts wherein the output voltage is fully temperature compensated.

These and other objects of the invention will be more readily understood upon review of the Detailed Description of the Preferred Embodiment of the Invention, below, together with the drawings in which.

DETAILED DESCRIPTION OF THE PREFERRED EMBODIMENT OF THE INVENTION

Figure 1:
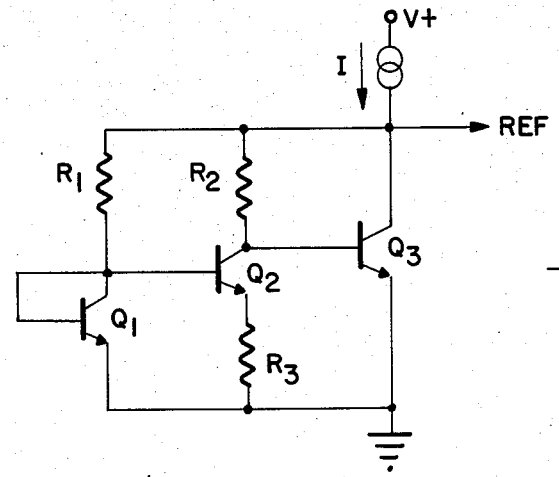
FIG. 1 (PRIOR ART)
FIG. 1 is a schematic diagram of Widlar's prior art integrated circuit voltage regulator having a lower output voltage limit equal to the energy band gap voltage of the silicon in which it is configured.
Figure 2:
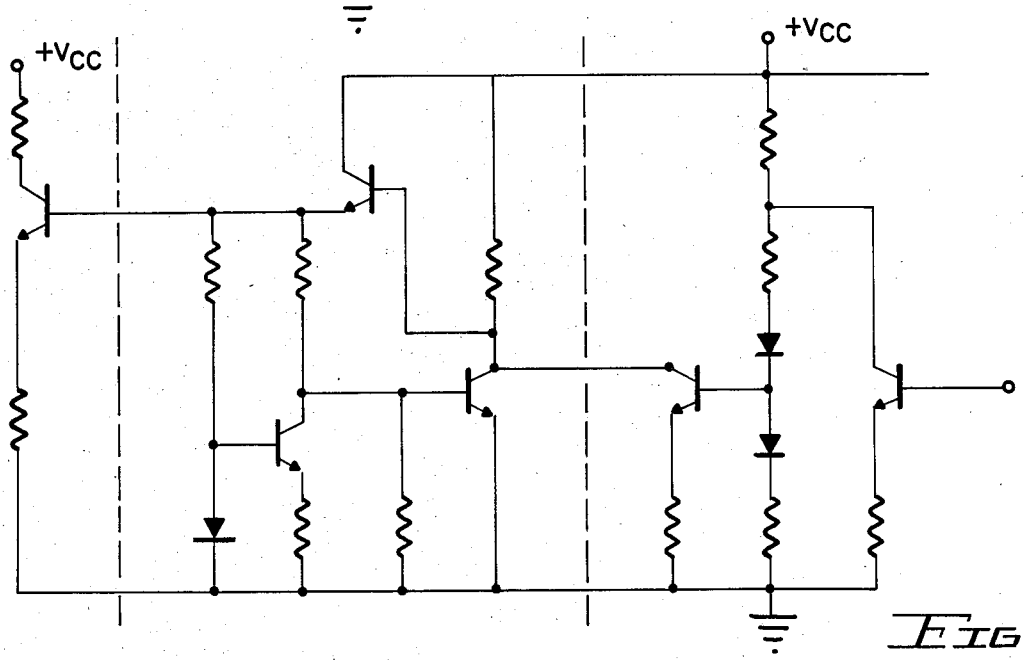
FIG. 2 (PRIOR ART)
FIG. 2 is a schematic diagram of Tam's prior art integrated circuit.
Figure 3:
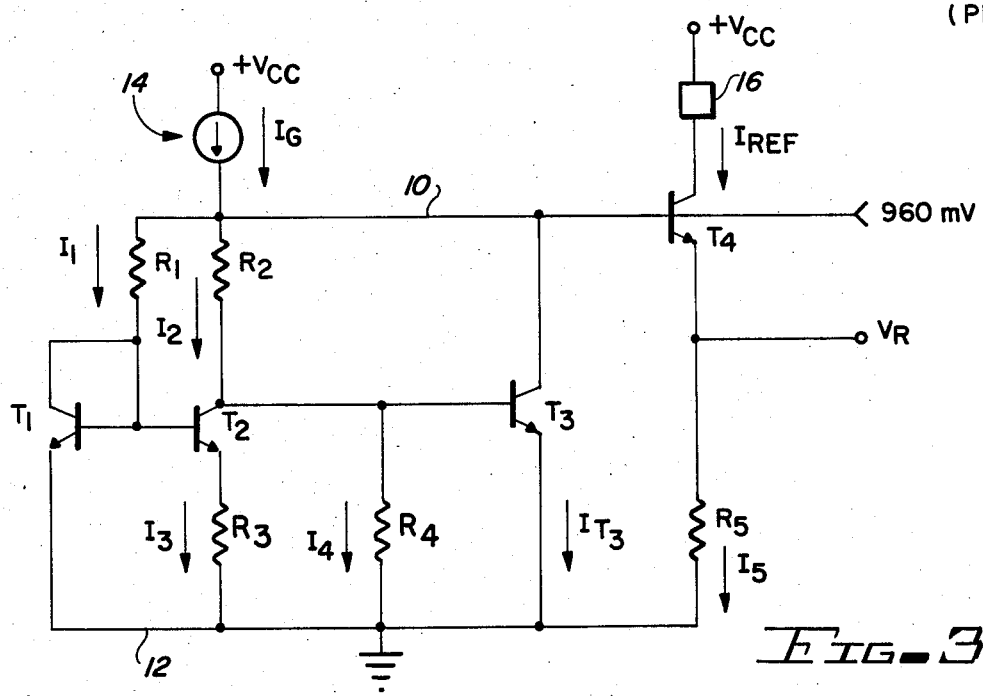
FIG. 3 is a schematic diagram of the preferred embodiment of the improved circuit of the invention.

Referring to FIG. 3, it is seen that T1 is a transistor connected as a diode with its collector connected to its base. The collector/base of T1 is connected through resistor R1 to node 10 and to the base of transistor T2. The emitter of transistor T1 is connected to the voltage reference, ground, node 12. The emitter of transistor T2 is connected through resistor R3 to ground, node 12. The collector of transistor T2 is connected through resistor R2 to node 10 and to one end of R4 and also to the base of transistor T3. The other end of resistor R4 is connected to ground, node 12. The collector of transistor T3 is connected to node 10 which is also connected to the base of transistor T4. The emitter of transistor T3 is connected to ground node 12. The emitter of transistor T4 is connected through resistor R5 to ground, node 12, and the emitter of transistor T4 is the output of the circuit, $V_R$. The collector of transistor T4 is the current reference output terminal of the circuit of FIG. 3 which is connected through load 16 to $V_{CC}$. Node 10 is connected to current source 14, also adapted from the source voltage $V_{CC}$. All transistors may be of the NPN type, as shown. Of course, the circuit may also be implemented with PNP type transistors. In FIG. 3, the convention is adopted whereby current I1 is the current through resistor R1, current I2 is the current through resistor R2; etc., and IT3 is the emitter current in transistor T3.

Resistors R2, R4 and transistor T3 comprise a $V_{BE}$ multiplier circuit with an input at the junction of resistors R2, R4 and the base of transistor T3 and an output at the collector of transistor T3.

Transistor T4 and resistor R5 comprise an emitter follower circuit with an input at the base of transistor T4 and an output, VR, at the emitter of transistor T4.

$V_{BE}$ is the base-emitter voltage and the temperature dependence can be shown to be:

$$V_{BE}=V_{GO}(1-T/T_0)+V_{BEO}(T/T_0) \quad (1)$$

From which it follows that:

$$dV_{BE}/dT=(V_{BEO}-V_{GO})/T_0 \quad (2)$$

Where: $V_{GO}=1205$ mV and is the extrapolated band-gap voltage of silicon at absolute zero temperature, and $V_{BEO}=660$ mV and is the base to emitter voltage of the NPN transistor measured at $T_0=298$ degrees and with an emitter current of 50 microamperes. It then follows that:

$$dV_{BE}/dT=(660-1205)/298=-1.83\ mV/degree\ C. \quad (3)$$

The temperature dependence of $\Delta V_{BE}$ is:

$$\Delta V_{BE} = V_T \ln(I1/I3) \quad (4)$$

$$d\Delta V_{BE}/dT = (V_T/T)\ln(I1/I3) = \Delta V_{BE}/T \quad (5)$$

$$= 60\ \text{mV}/298\ \text{degrees}$$

$$= 0.2\ \text{mV/degree C.}$$

Where: $V_{BE}=60$ mV is obtained in the transistor T2 having ten times the area of transistor T1 and both transistors are conducting 50 microamperes of current. It follows that R3 must have a value of 1200 ohms.

For the circuit of FIG. 3:

$$V_R=V_{BE3}(1+R2/R4)+\Delta V_{BE}(R2/R3)-V_{BE4} \quad (6)$$

Note that $V_{BE4}$, the base-emitter voltage of transistor T4, is an element of the equation. The equations for $V_R$ in prior art circuits did not employ that term. Equation (6) can be rewritten as:

$$V_R=(V_{BE3}-V_{BE4})+V_{BE3}(R2/R4)+\Delta V_{BE}(R2/R3) \quad (7)$$

Now, assuming that transistor T3 has identical characteristics with transistor T4 and both T3 and T4 are equally biased as will be the case when the circuit is implemented in a monolithic structure and matched:

$$V_{BE3}-V_{BE4}=0$$

and equation (7) becomes:

$$V_R=V_{BE3}(R2/R4)+\Delta V_{BE}(R2/R3) \quad (8)$$

$$V_R[V_{BE3}+(\Delta V_{BE})(R4/R3)](R2/R4) \quad (8a)$$

Compare these equations (8 and 8*a*) to equations (a) and (b), supra. It may be seen that the output regulated voltage is no longer limited at its lower level by the band-gap voltage of silicon, see infra. Note that $V_{BE4}$ has disappeared from the equation, but, of course, is still of effect because of the identity between $V_{BE3}$ and $V_{BE4}$. Now, taking the derivative of equation (8) with respect to temperature and setting that derivative equal to zero:

$$dV_R/dT=(dV_{BE3}/dT)(R2/R4)+(d\Delta V_{BE}/dT)(R2/R3)=0 \quad (9)$$

From which it follows that:

$$R4/R3=(dV_{BE}/dT)/(d\Delta V_{BE}/dT)=1.83/0.2=9.15 \quad (10)$$

$$R4/R3=9.15,\ R3=1200\ \text{ohms, and}\ R4=10980\ \text{ohms} \quad (11)$$

If equation (10) is respected, $V_R$ is temperature independent. The absolute value of R2 determines the absolute value of $V_R$:

$$V_R=[(V_{BE3}/R4)+(\Delta V_{BE}/R3)]R2 \quad (12)$$

Where the bracketed [] term is Ieq.

$V_{BE3}/R4=660$ mV/10.98 kohms=60.1 microamperes, $\Delta V_{BE}/R3=60$ mV/1.2=50 microamperes $Ieq=60.1+50=110.1$ *microamperes*

$V_R=300\ mV$ *and* $R2=V_R/Ieq=300\ mV/110.1$ microamperes=2.72 kohms (13)

Other circuit values are easily obtained:

I1=I3=I5=I6=50 microamperes

I2=110.1 microamperes

R5=R1=6000 ohms

VS=1060 mVolts *

So it may be seen that the circuit of FIG. 3 requires a typical supply voltage of 1060 millivolts *. (* $V_S=1060$ mV if the $V_{SAT}$ of current source 14 ($I_G$) is assumed to be 100 mVolts.) The circuit of FIG. 3 may also be used to supply a reference current, $I_{REF}$:

$$I_{REF}=V_R/R5 \quad (14)$$

If R5 is an integrated circuit resistor, it may be coupled with an internal resistor having a value of $R_X$ such that other reference voltages $V_R'$ may be generated:

$$V_R'=V_R(R_X/R5) \quad (15)$$

Furthermore, if R5 is an external resistor, the current $I_{REF}$ becomes a true reference current. In a conventional band-gap voltage reference circuit of the prior art, it can be shown that the reference voltage is equal to the band-gap voltage of silicon:

$$V_R \simeq V_{GO} \quad (16)$$

In the instant invention, the voltage reference is equal to a fraction of $V_{GO}$:

$$V_R = V_{BE3}(R2/R4) + \Delta V_{BE}(R2/R3)\,[R2/R4][V_{BE3} + \Delta V_{BE}(R4/R3)] \quad (17)$$

The condition of zero temperature coefficient occurs when:

$$(dV_{BE3}/dT)((R2/R4 + (d\Delta V_{BE}/dT)(R2/R3) = 0 \quad (18)$$

From which the following may be derived:

$$(R4/R3) = -(dV_{BE3}/dT)/(d\Delta V_{BE}/dt) \quad (19)$$

By substituting equation (19) into equation (17), the following is produced:

$$V_R = (R2/R4)(V_{BE}3 - \Delta V_{BE}(dV_{BE}3/dT)/(d\Delta V_{BE}/dt) \quad (20)$$

It is also known that:

$$dV_{BE3}/dT = (V_{BE3} - V_{GO})/T,\ d\Delta V_{BE}/dT = \Delta V_{BE}/T$$

from which it can be stated:

$$(dV_{BE3}/dT)/d\Delta V_{BE}/dT = (V_{BE3}/V_{GO})/\Delta V_{BE} \quad (21)$$

And:

$$\begin{aligned} V_R &= (R2/R4)[V_{BE3} - \Delta V_{BE}(V_{BE3} - V_{GO})/\Delta V_{BE})] \quad (22) \\ &= (R2/R4)(V_{BE3} - V_{BE3} + V_{GO}) \\ &= (R2/R4)V_{GO} \end{aligned}$$

Where R2/R4 can assume any positive value. In practical circuits, the value of $V_R$ attained has been as low as 300 millivolts or less than one-quarter of the band-gap voltage of silicon.

While the invention has been particularly shown and described herein with reference to a preferred embodiment thereof, it will be understood by those skilled in the art that various other modifications and changes may be made to the present invention from the principles of the invention described above without departing from the spirit and scope thereof as encompassed in the accompanying claims. Therefore, it is intended in the appended claims to cover all such equivalent variations as may come within the scope of the invention as described.

What is claimed is:

1. In a prior art integrated circuit voltage regulator having an unregulated voltage input terminal and a regulated voltage output terminal, and further comprising:

a first transistor having an emitter, a collector and a base, the first transistor having a first base-emitter voltage characteristic, the collector of the first transistor being connected through a first resistor to a current source, said current source being derived from the unregulated voltage, the emitter of the first transistor being connected through a second resistor to a reference voltage; and a second transistor having an emitter, a collector and a base, the second transistor having a second base-emitter voltage characteristic, the base of the second transistor being connected to the collector of the first transistor, the collector of the second transistor being connected to the current source, the emitter of the second transistor being connected to the reference voltage, the regulated output of the voltage regulator being provided at the collector of the second transistor and the regulated voltage output being a function of the first base-emitter voltage characteristic of the first transistor plus the quantity comprising the difference between the first base-emitter voltage characteristic of the first transistor and the second base-emitter voltage characteristic of the second transistor, times the ratio of the value of resistance of the first resistor and the value of resistance of the second resistor;

the improvement comprising:

a third transistor having a collector, an emitter and a base, said third transistor having a third base-emitter voltage characteristic, said third base-emitter voltage characteristic being substantially equal to said second base-emitter voltage characteristic, said collector of said third transistor being connected to the unregulated voltage source through a load, said emitter of said third transistor being connected to the voltage reference through a third resistor and said base of said third transistor being connected to the current source; and a fourth resistor being connected between the collector of the first transistor and the reference voltage, a regulated and temperature compensated voltage source being provided from said emitter of said third transistor, said regulated and temperature compensated voltage being regulated with respect to the reference voltage, and said emitter of said third transistor being connected to the regulated voltage output terminal.

2. An improvement in a prior art integrated circuit voltage regulator wherein the prior art integrated voltage regulator comprises:

a diode having a first and a second terminal, said first terminal of said diode being connected to a first terminal of a first resistor and the second terminal of the diode is connected to a ground, a second terminal of the first resistor is connected to a current source which is derived from an unregulated voltage source;

a first transistor having a first, a second and a third terminal, the first terminal of the second transistor is connected to a first terminal of a second resistor, a second terminal of the second resistor is connected to the current source, the second terminal of the second transistor is connected to the first terminal of the diode and to the first terminal of the first resistor and the third terminal of the first transistor is connected to a first terminal of a third resistor, a second terminal of the third resistor is connected to the ground; and a second transistor having a first, a second and a third terminal, the first terminal of the second transistor is connected to the current source, the second terminal of the second transistor is connected to the first terminal of the first transistor and to the first terminal of the second resistor, the third terminal of the third transistor is connected to the ground;

the improvement comprising:

a fourth resistor, said fourth resistor having a first terminal connected to the first terminal of the first transistor, to the second terminal of the second transistor and to the first terminal of the second resistor, a second terminal of said fourth resistor is connected to the ground; and a third transistor having a first, a second and a third terminal, said first terminal of said third transistor is connected to the unregulated voltage source through a load, said second terminal of said fourth transistor is connected to the current source, said third terminal of said third transistor is connected to a first terminal of a fifth resistor, a second terminal of said fifth resistor is connected to the ground, said third terminal of said third transistor providing a regulated voltage output from said third transistor.

3. The improved integrated circuit voltage regulator according to claim 2 wherein said first terminal of each of said transistors is a collector terminal, said second terminal of each of said transistors is a base terminal and said third terminal of each of said transistors is an emitter terminal and wherein each of said transistors is an NPN type transistor.

4. The improved integrated circuit voltage regulator according to claim 2 wherein said first terminal of each of said transistors is a collector terminal, said second terminal of each of said transistors is a base terminal and said third terminal of each of said transistors is an emitter terminal and wherein each of said transistors is a PNP type transistor.

5. An improvement in a prior art integrated circuit voltage regulator wherein the prior art integrated voltage regulator has an unregulated voltage input terminal and a regulated voltage output terminal, and further comprises:

a first transistor having an emitter, a collector and a base, the first transistor having a first base-emitter voltage characteristic, the collector of the first transistor being connected through a first resistor to a current source, said current source being derived from the unregulated voltage, the emitter of the first transistor being connected through a second resistor to a reference voltage; and a second transistor having an emitter, a collector and a base, the second transistor having a second base-emitter voltage characteristic, the base of the second transistor being connected to the collector of the first transistor, the collector of the second transistor being connected to the current source, the emitter of the second transistor being connected to the reference voltage, the regulated output of the voltage regulator being provided at the collector of the second transistor and the regulated voltage output being a function of the first base-emitter voltage characteristic of the first transistor plus the quantity comprising the difference between the first base-emitter voltage characteristic of the first transistor and the second base-emitter voltage characteristic of the second transistor, times the ratio of the value of resistance of the first resistor and the value of resistance of the second resistor;

the improvement comprising:

means for providing a $V_{BE}$ multiplier, said $V_{BE}$ multiplier means having an input terminal and an output terminal, said input terminal of said $V_{BE}$ multiplier means being connected to the collector of the second transistor and said output terminal of said $V_{BE}$ multiplier means being connected to the current reference; and emitter follower means for providing a regulated and temperature compensated output voltage, said emitter follower means having an input terminal and an output terminal, said input terminal of said emitter follower means being connected to said output terminal of said output terminal of said $V_{BE}$ multiplier means, said output terminal of said emitter follower means providing the regulated and temperature compensated output voltage.

6. An improvement in a prior art integrated circuit voltage regulator wherein the prior art integrated voltage regulator comprises:

a diode having a first and a second terminal, said first terminal of said diode being connected to a first terminal of a first resistor and the second terminal of the diode is connected to a ground, a second terminal of the first resistor is connected to a current source which is derived from an unregulated voltage source;

a first transistor having a first, a second and a third terminal, the first terminal of the second transistor is connected to a first terminal of a second resistor, a second terminal of the second resistor is connected to the current source, the second terminal of the second transistor is connected to the first terminal of the diode and to the first terminal of the first resistor and the third terminal of the first transistor is connected to a first terminal of a third resistor, a second terminal of the third resistor is connected to the ground; and a second transistor having a first, a second and a third terminal, the first terminal of the second transistor is connected to the current source, the second terminal of the second transistor is connected to the first terminal of the first transistor and to the first terminal of the second resistor, the third terminal of the third transistor is connected to the ground;

the improvement comprising:

means for providing a $V_{BE}$ multiplier, said $V_{BE}$ multiplier means having an input terminal and an output terminal, said input terminal of said $V_{BE}$ multiplier means being connected to the first terminal of the second transistor and said output terminal of said $V_{BE}$ multiplier means being connected to the current reference; and emitter follower means for providing a regulated and temperature compensated output voltage, said emitter follower means having an input terminal and an output terminal, said input terminal of said emitter follower means being connected to said output terminal of said $V_{BE}$ multiplier means, said output terminal of said emitter follower means providing the regulated and temperature compensated output voltage.

* * * * *